US008963724B2

(12) United States Patent
Chang

(10) Patent No.: US 8,963,724 B2
(45) Date of Patent: Feb. 24, 2015

(54) SYSTEM AND METHOD FOR AROUSING A DROWSY DRIVER WITHOUT DROWSINESS DETECTION

(75) Inventor: Hsuan Chang, Los Altos, CA (US)

(73) Assignee: Honda Motor Co., Ltd., Tokyo (JP)

( * ) Notice: Subject to any disclaimer, the term of this patent is extended or adjusted under 35 U.S.C. 154(b) by 480 days.

(21) Appl. No.: 13/237,768

(22) Filed: Sep. 20, 2011

(65) Prior Publication Data

US 2013/0069788 A1 Mar. 21, 2013

(51) Int. Cl.
*G08B 21/06* (2006.01)

(52) U.S. Cl.
CPC ..... *G08B 21/06* (2013.01)
USPC ..... 340/575; 340/425.5; 340/539.27; 340/435; 340/438; 701/45; 701/117

(58) Field of Classification Search
USPC ..... 340/500, 539.26, 539.27, 575, 576, 340/436, 425.5, 435, 438, 439; 701/45, 701/117; 348/148; 180/6.2, 252, 253
See application file for complete search history.

(56) References Cited

U.S. PATENT DOCUMENTS

| | | | | |
|---|---|---|---|---|
| 6,313,749 | B1 * | 11/2001 | Horne et al. | 340/575 |
| 6,509,552 | B1 * | 1/2003 | Roske et al. | 219/497 |
| 7,321,309 | B2 | 1/2008 | Cohen | |
| 7,875,066 | B2 | 1/2011 | Cohen et al. | |
| 7,924,142 | B2 | 4/2011 | Cohen et al. | |
| 2001/0030182 | A1 | 10/2001 | Haag et al. | |
| 2002/0101354 | A1 * | 8/2002 | Banas | 340/576 |
| 2003/0096593 | A1 | 5/2003 | Naboulsi | |
| 2006/0238359 | A1 | 10/2006 | Cohen | |
| 2008/0045913 | A1 | 2/2008 | Johnson et al. | |
| 2008/0180235 | A1 * | 7/2008 | Chang | 340/449 |
| 2010/0076273 | A1 * | 3/2010 | Shigetou | 600/300 |
| 2010/0214087 | A1 * | 8/2010 | Nakagoshi et al. | 340/436 |
| 2011/0109462 | A1 | 5/2011 | Deng et al. | |

FOREIGN PATENT DOCUMENTS

| | | |
|---|---|---|
| WO | WO 2006/115562 | 11/2006 |
| WO | WO 2008/020347 | 2/2008 |
| WO | WO 2008/072107 | 6/2008 |
| WO | WO 2009/007952 | 1/2009 |

OTHER PUBLICATIONS

PCT International Search Report and Written Opinion, PCT Application No. PCT/US2012/55203, Dec. 7, 2012, five pages.

* cited by examiner

*Primary Examiner* — Vernal Brown
*Assistant Examiner* — Sisay Yacob
(74) *Attorney, Agent, or Firm* — Fenwick & West LLP; Mark E. Duell

(57) ABSTRACT

A system for preventing drowsiness in a driver by employing a thermal grill that includes warm and cool regions. The system includes a threshold determination module and a configuration module. The threshold determination module determines temperatures for warm and cool regions corresponding to a level below the driver's pain threshold. The warm and cool regions configured at these determined temperatures do not cause an uncomfortable sensation for an alert driver. Accordingly, the configuration module configures the thermal grill to these determined temperatures. As the driver gets drowsy, the driver's pain threshold falls, the configured thermal grill causes an uncomfortable sensation for the driver and alerts the driver.

18 Claims, 4 Drawing Sheets

SYSTEM AND METHOD FOR AROUSING A DROWSY DRIVER WITHOUT DROWSINESS DETECTION

BACKGROUND

1. Field of Disclosure

The disclosure generally relates to driver and vehicle safety, in particular to preventing drowsiness.

2. Description of the Related Art

Vehicle manufacturers today are developing various safety features for detecting sleep onset and then alerting the driver. For example, conventional systems blow air on the driver's face or play an alert sound to alert a drowsy driver. However, such sleep detection systems are not completely accurate and sometimes lead to false positives that annoy the driver.

SUMMARY

Embodiments of the invention prevent drowsiness in a driver by employing a thermal grill. The disclosed system includes a threshold determination module and a configuration module. The threshold determination module determines a configuration for a thermal grill corresponding to a level below the driver's pain threshold. The thermal grill comprises interlaced warm and cold regions. To determine the corresponding configuration for the thermal grill, the threshold determination module configures a warm region in the grill to a first temperature and a cold region in the grill to a second temperature. The threshold determination module then receives feedback from the driver indicating whether the thermal grill caused an uncomfortable sensation. The threshold determination module iteratively varies the temperature of the warm and cold regions until the driver senses the uncomfortable sensation. Upon receiving an input indicating that the driver has sensed an uncomfortable sensation, the threshold determination module stores the regions' temperatures for the immediately preceding iteration as the configuration corresponding to a level below the driver's pain threshold.

Next, the configuration module configures the warm regions and cold regions in the thermal grill to the stored temperatures. Because the thermal grill is configured to a level below the driver's pain threshold, the driver does not sense an uncomfortable sensation because of the configured thermal grill. However, as the driver gets drowsy, the driver's pain threshold drops and the driver senses the uncomfortable sensation. The uncomfortable sensation alerts the driver which increases the arousal level of the driver whose pain threshold rises again as a result, and the now-alert driver does not sense the uncomfortable sensation.

Other embodiments of the invention include computer-readable medium that store instructions for implementing the above described functions of the system, and computer-implemented method that includes steps for performing the above described functions.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the disclosed subject matter.

DETAILED DESCRIPTION

The computing environment described herein alerts a drowsy driver without monitoring the driver's drowsiness. The figures and the following description describe certain embodiments by way of illustration only. One skilled in the art will readily recognize from the following description that alternative embodiments of the structures and methods illustrated herein may be employed without departing from the principles described herein. Reference will now be made in detail to several embodiments, examples of which are illustrated in the accompanying figures. It is noted that wherever practicable similar or like reference numbers may be used in the figures and may indicate similar or like functionality.

Relationship Between a Driver's Drowsiness and Pain Threshold

Human body senses pain through its nociceptor system. To feel the pain, the pain input signal has to exceed a threshold called the pain-threshold. This pain-threshold is related to a driver's sleep debt such that the drowsier the driver, the more susceptible he is to pain.

The disclosed methods and systems deliver a configurable pain illusion or an uncomfortable sensation corresponding to a level below the alert driver's pain threshold. As the driver becomes drowsy, the driver's pain threshold drops and the driver begins to sense the delivered sensation. The delivered sensation serves as a wake-up call and alerts the drowsy driver. As the driver becomes alert, the driver's pain threshold rises and the driver does not sense the delivered sensation.

The disclosed methods and systems deliver this sensation using a pain illusion caused by a Thunberg Thermal Grill (hereinafter referred to as "TTG"). The TTG, also known as thermal grill, is further described in U.S. Pat. No. 7,321,309, which is incorporated by reference herein in its entirety. The TTG comprises interlaced warm and cold regions that are configured to different temperatures. The temperature difference between the warm and cold bars can be used to manipulate the magnitude of uncomfortable sensation perceived by the driver who is in contact with the TTG. A wider gap between the temperatures of the warm regions and cold regions increases and a smaller gap reduces the magnitude of the uncomfortable sensation, for example.

System Environment

Figure 1:
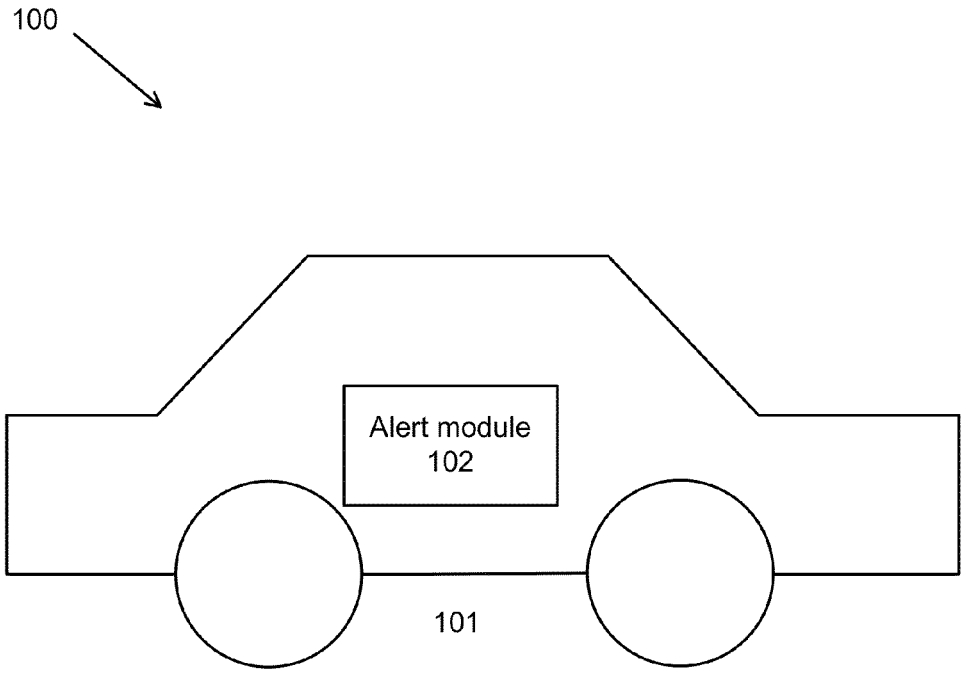
FIG. 1 is a block diagram illustrating a computing environment for alerting a drowsy driver without monitoring the driver's drowsiness according to one embodiment.

Referring to FIG. 1, the computing environment 100 for alerting a drowsy driver comprises an alert module 102. In one embodiment, the alert module 102 is located in the vehicle 101 driven by the driver. In another embodiment, the alert module 102 is located in a remote location and the alert module 102 wirelessly communicates with various components in the vehicle 101. Regardless of the location of the alert module 102, the alert module 102 determines the pain threshold of the alert driver and configures a TTG within the vehicle 101 based on the determined pain threshold. The configured TTG prevents a driver from getting drowsy as described below.

The TTG is located in the vehicle 101 such that it is in contact with the driver. For example, the TTG can be located on the steering wheel such that the TTG is in contact with part of the driver's palms. The TTG comprises interlaced warm and cold regions or bars. In one embodiment, the alert module 102 determines a TTG configuration corresponding to a level below the alert driver's pain threshold and configures the temperatures of the TTG's warm bars and cold bars based on this pre-determined configuration.

Because the TTG is configured to a level below the alert driver's pain threshold, the TTG does not cause an uncomfortable sensation for the alert driver. However, if the driver gets drowsy, the driver's pain threshold drops and the driver's sensitivity to pain increases. Accordingly, the driver senses pain or uncomfortable sensations in response to stimulation that did not induce such sensations for an alert driver. Therefore, the drowsy driver with the lowered pain threshold senses an uncomfortable sensation induced by TTG that is configured a level below to the alert driver's pain threshold. Examples of this uncomfortable sensation include an icy hot sensation, a painful sensation or a sensation resembling a sting from a brief, low current electric shock. The magnitude of this sensation is related to the temperature of the warm and cold regions in the TTG as described above. The WIPO publication WO 2009/007952 provides additional details and examples of this sensation, and this WIPO publication WO2009/007952 is incorporated by reference herein in its entirety. This TTG induced uncomfortable sensation lasts while the driver has the lowered pain threshold.

As the driver becomes alert again, the driver's pain threshold increases and the alert driver stops sensing the uncomfortable sensation. In this manner, the alert module 102 beneficially configures the TTG to a level below the alert driver's pain threshold such that the configured TTG alerts a drowsy driver without needing to detect when the driver is drowsy. The alert module 102 is further described in FIG. 2 below.

Figure 2:
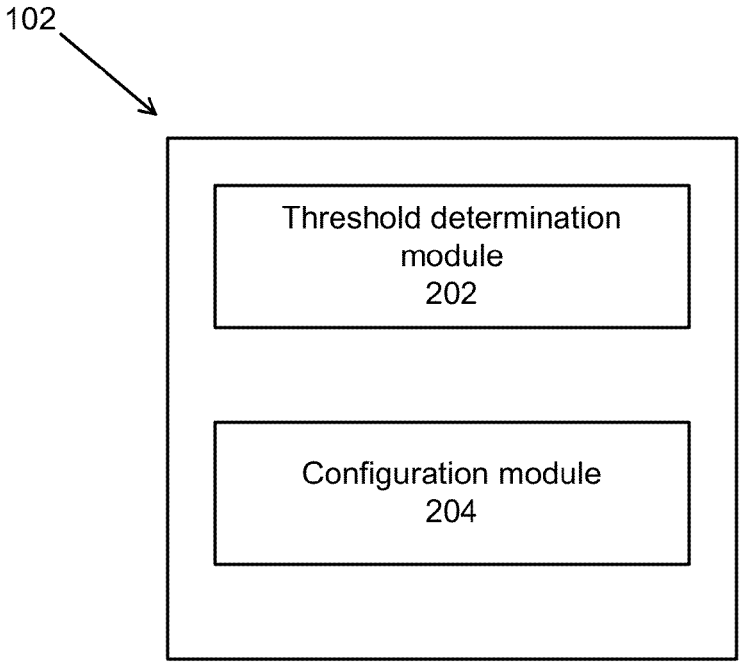
FIG. 2 is a block diagram illustrating a driver alert module according to one embodiment.

As illustrated in FIG. 2, the alert module 102 comprises a threshold determination module 202 and a configuration module 204. The threshold determination module 202 determines a TTG configuration corresponding to a level below the alert driver's pain threshold. To determine this configuration, the threshold determination module 202 configures the TTG's cold and warm bars to two different temperatures. The threshold determination module 202 then prompts the driver to place his hand on the TTG and indicate whether the driver senses an uncomfortable sensation. The threshold determination module 202 may prompt the driver through a visual prompt (not shown) or an audio prompt (not shown).

The driver may indicate whether or not the driver senses the uncomfortable sensation through an input device (not shown) like a switch or a touch screen located in the vehicle 101. If the driver indicates that the driver does not sense the uncomfortable sensation, the threshold determination module 202 increases the temperature of the warm bars and/or decreases the temperature of the cold bars. The threshold determination module 202 then prompts the driver again to place his hands on the configured TTG and indicate the presence or lack of uncomfortable sensation. The threshold determination module 202 repeats this process until the driver indicates sensing the uncomfortable sensation.

In one embodiment, the threshold determination module 202 does not prompt the driver in every iteration. Instead, the threshold determination module 202 initially prompts the driver to indicate when the driver senses the uncomfortable sensation. In this embodiment, the threshold determination module 202 keeps varying the temperature of one or more TTG bars and waits for the driver to indicate the TTG configuration that produces the uncomfortable sensation. In another embodiment, the driver gets the instructions for TTG configuration from another source and the threshold determination module 202 does not prompt the driver. Instead, the threshold determination module 202 waits for the driver to indicate the TTG configuration that produces the uncomfortable sensation.

In one embodiment, the threshold determination module 202 does not increase the temperature of the warm bars and decrease the temperature of the cold bars in every iteration. Instead, the threshold determination module 202 increases the temperature of the warm bars, but does not decrease the temperature of the cold bars, and determines whether the configured TTG produces an uncomfortable sensation. If not, the threshold determination module 202 then decreases the temperature of the cold bars, but does not further increase the temperature of the warm bars, and determines whether the configured TTG produces an uncomfortable sensation. The threshold determination module 202 repeats the process of alternatively increasing the temperature of warm bars and decreasing the temperature of cold bars until the driver indicates sensing the uncomfortable sensation.

After the threshold determination module 202 receives an input indicating that the driver senses the uncomfortable sensation, the threshold determination module 202 stores the temperatures for the immediately preceding iteration as the TTG configuration corresponding to a level below the alert driver's pain threshold. For example, for a driver, the threshold determination module 202 determines that the driver does not sense the uncomfortable sensation when the warm bars are configured to 39 degrees Celsius and the cold bars are configured to 20 degrees Celsius. The threshold determination module 202 then configures the warm bars to 40 degrees and cold bars to 20 degrees, and prompts the driver to indicate whether the driver detects the uncomfortable sensation. Upon receiving an indication that the driver does detect the uncomfortable sensation, the threshold determination module 202 stores configuration of warm bars at 39 degrees and cold bars at 20 degrees as the configuration corresponding to a level below the driver's pain threshold.

In another embodiment, the driver, instead of the threshold module, controls the variation in configurations through an input device (not shown) like a knob, a switch or a touch screen. In this embodiment, the driver varies the TTG configuration using the input device and indicates to the threshold determination module 202 the configuration that causes the uncomfortable sensation. The driver may indicate this configuration through another input device (not shown) or by not varying the TTG configuration once the driver senses the uncomfortable sensation. The threshold determination module 202 tracks the various configurations being used by the driver during the process. After the driver indicates the configuration causing the uncomfortable sensation, the threshold determination module 202 stores the configuration immediately preceding the indicated configuration as the configuration corresponding to a level below the driver's pain threshold.

In one embodiment, the threshold determination module 202 also stores one or more additional configurations preceding the configuration corresponding to a level below the driver's pain threshold. These additional configurations enable the configuration module 204 to provide the driver with the option of setting the alert module to different sensitivity levels as discussed below.

In one embodiment, the threshold determination module 202 periodically repeats this process for a driver. For example, in one embodiment, the threshold determination module 202 determines the TTG configuration corresponding to a level below an alert driver's pain threshold every three months. Such periodic determination beneficially enables the alert module 102 to recalibrate the TTG to account for any changes in the driver's pain threshold. In another embodiment, the driver may select an input indicating that the driver wants to recalibrate the alert module 102 and the threshold determination module 202 again determines the TTG configuration for the driver.

In another embodiment, the threshold determination module 202 determines for a driver different TTG configurations for different times of the day. A driver may be more alert at 8 am in the morning than 9 pm at night. The threshold determination module 202, in one embodiment, accounts for the driver's sleep cycle by repeating the above mentioned steps at different times in the day to determine TTG configurations corresponding to different parts of the driver's circadian clock.

After the threshold determination module 202 has determined and stored the TTG configuration corresponding to a level below the alert driver's pain threshold, the configuration module 204 may configure the TTG located in the vehicle 101 to this pre-determined configuration. In one embodiment, the threshold determination module 202 has determined different TTG configurations for different times of the day, and the configuration module 204 configures the TTG based on the current time of the day.

Figure 4A:
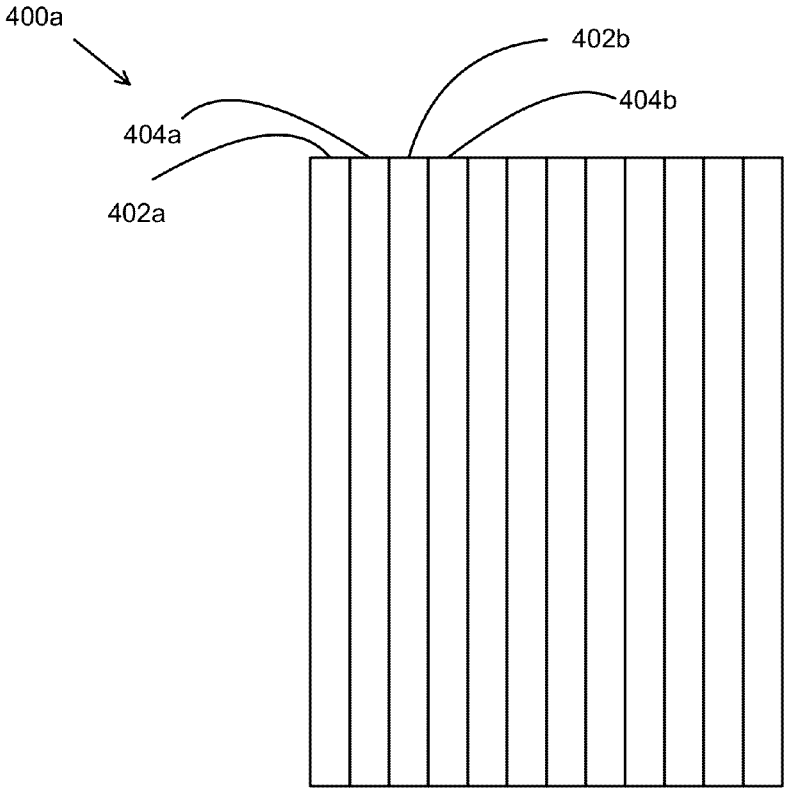
FIG. 4A is a block diagram illustrating a thermal grill for alerting a drowsy driver according to one embodiment.
Figure 4B:
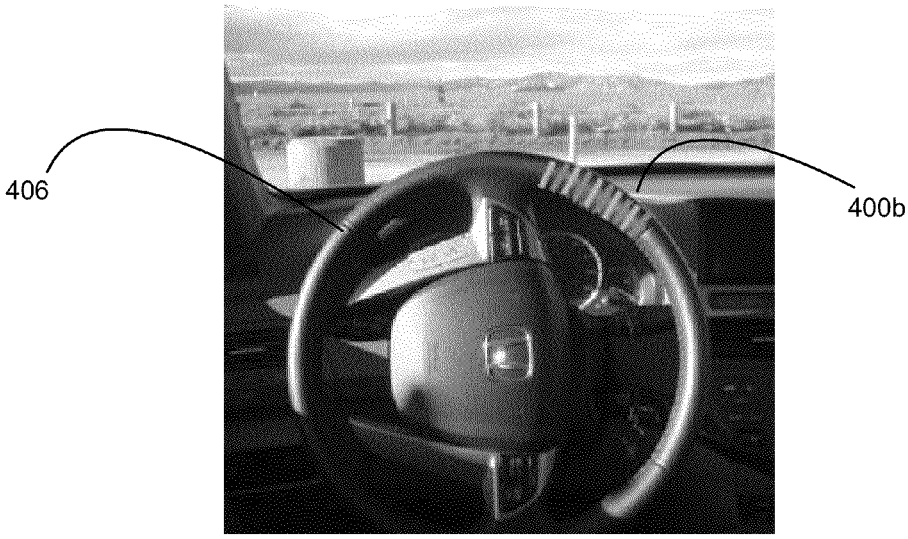
FIG. 4B is a block diagram illustrating a thermal grill mounted on a steering wheel for alerting a drowsy driver according to one embodiment.

FIG. 4A illustrates an example of TTG in vehicle 101. As illustrated in FIG. 4A, the TTG 400*a* comprises alternating hot regions 402*a-b* and cold regions 404*a-b*. The TTG 400*a* may be mounted in various locations in the vehicle 101 such that the TTG is in contact with the driver. FIG. 4B illustrates one such location wherein, according to one embodiment, the TTG 400*b* is located on the steering wheel 406 of the vehicle according to one embodiment. Placing the TTG on the steering wheel 406 beneficially places the TTG 406 in constant contact with the driver's palms and allows the TTG to alert the driver when the driver becomes drowsy.

Referring again to FIG. 2, in one embodiment, the configuration module 204 configures the TTG to the pre-determined configuration after the driver turns on the vehicle. In another embodiment, the configuration module 204 receives an input from the driver indicating his desire to turn on the alert module 102. The configuration module 204, in this embodiment, configures the TTG to the pre-determined configuration upon receiving the input.

In another embodiment, the configuration module 204 configures the TTG to the pre-determined configuration after the driver has been driving the vehicle 101 for a predetermined time. For example, if a driver initially chooses against activating the alert module 102, the configuration module 204 determines if the driver has been driving the vehicle for an amount of time. If so, the configuration module 204 configures the TTG to the pre-determined configuration corresponding to a level below the driver's pain threshold. In one embodiment, the configuration module 204 provides a visual or audio warning before configuring the TTG. In yet another embodiment, after receiving the warning, the driver may select an input indicating to the configuration module 204 whether or not to configure the TTG. In this embodiment, the configuration module 204 configures the TTG unless the driver has indicated otherwise.

In another embodiment, the configuration module 204 prompts the driver to set the sensitivity level of the alert module 102. This sensitivity level beneficially provides the driver with a window of opportunity to avoid the uncomfortable sensation and recover from a drowsy period without the TTG's assistance. For example, the driver can choose a lower sensitivity level and the configuration module 204 configures the TTG to one of the additional stored configurations instead of the configuration corresponding to a level below the driver's pain threshold. Such configurations induce the uncomfortable sensation for the drowsy driver later than the configuration corresponding to a level below the driver's pain threshold. Accordingly, these configurations provide the driver with the opportunity to snap out of the drowsy spell himself before the driver senses the uncomfortable sensation. However, if the driver does not snap out of the drowsy spell and instead gets drowsier, the driver's pain threshold drops further, and the additional configuration induces the uncomfortable sensation and alerts the driver. In this case, the delivered pain illusion may be of a larger magnitude to account for the deeper drowsy state of the driver.

In one embodiment, the threshold determination module 202 stores multiple additional configurations and the driver can choose between various sensitivity levels. For example, the driver may choose a sensitivity level 1 to configure the TTG to a level below the driver's pain threshold, and a sensitivity level 2-5 to configure the TTG to additional configurations. The configurations corresponding to sensitivity levels 2-5 have bar temperatures that are farther and farther from the bar temperatures for sensitivity level 1. Accordingly, the bars at sensitivity level 2 are closer in temperature to their corresponding bars in sensitivity level 1, as compared to the bars at sensitivity level 4.

Figure 3:
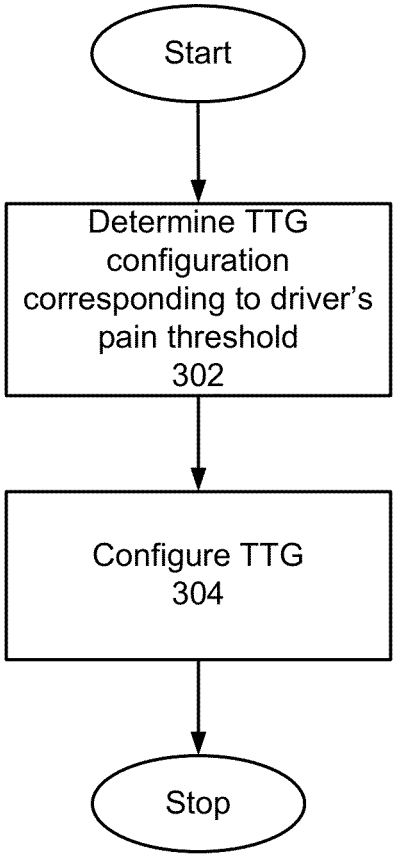
FIG. 3 is a flow diagram illustrating a method for alerting a drowsy driver without monitoring the driver's drowsiness according to one embodiment.

FIG. 3 is a flow diagram illustrating a method for preventing drowsiness in a driver. The driver enters the vehicle 101 and the alert module 102 determines 302 the TTG configuration corresponding to a level below the driver's pain threshold. In one embodiment, the alert module 102 periodically repeats this process and again determines the configuration to account for any changes over time in the driver's pain threshold. After the TTG configuration has been determined, the alert module 102 configures 304 the TTG to the pre-determined configuration. Accordingly, the alert module 102 need not monitor the driver to determine whether the driver is drowsy. Instead, the alert module 102 configures the TTG to the pre-determined configuration. The configured TTG does not cause an uncomfortable sensation for the alert driver, but as the driver gets drowsy and the driver's pain threshold falls, the configured TTG beneficially causes an uncomfortable sensation for the driver and alerts the driver.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above disclosure.

Some portions of this description describe the embodiments of the invention in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof. One of ordinary skill in the art will understand that the hardware, implementing the described modules, includes at least one processor and a memory, the memory comprising instructions to execute the described functionality of the modules.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the invention may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments of the invention may also relate to a product that is produced by a computing process described herein. Such a product may comprise information resulting from a computing process, where the information is stored on a non transitory, tangible computer readable storage medium and may include any embodiment of a computer program product or other data combination described herein.

Finally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention, which is set forth in the following claims.

What is claimed is:

1. A computer-implemented method for preventing drowsiness in a driver of a vehicle having a memory and a processor to execute steps comprising:

determining a configuration for a thermal grill located on a steering wheel of the vehicle corresponding to a level below a pain threshold of the driver, the thermal grill comprising warm regions interlaced with cool regions, the thermal grill located on an outer surface of the steering wheel such that at least one warm region and at least one cool region simultaneously configured to different temperatures are exposed on the outer surface of the steering wheel at a location on the steering wheel such that the at least one warm region and the at least one cool region are in contact with a hand of the driver when the driver is gripping the steering wheel, the determining including:

configuring the at least one warm region to a first temperature, configuring the at least one cool region to a second temperature, and receiving input indicating whether the thermal grill, including regions with the first temperature and the second temperature, produces an uncomfortable sensation for the driver;

storing the determined configuration for the thermal grill corresponding to the level below the pain threshold of the driver; and configuring the thermal grill to the stored configuration during vehicle operation.

2. The computer-implemented method of claim 1, wherein the thermal grill is configured to the stored configuration responsive to receiving an input indicating that the driver wants the thermal grill configured.

3. The computer-implemented method of claim 1, wherein the thermal grill is configured to the stored configuration after an amount of time has elapsed since receiving an input indicating that the driver does not want the thermal grill configured.

4. The computer-implemented method of claim 1, further comprising providing a warning to the driver before configuring the thermal grill to the stored configuration.

5. The computer-implemented method of claim 1, wherein the step of determining the configuration is repeated after an amount of time has lapsed.

6. The computer-implemented method of claim 1, further comprising:

storing additional configurations for the thermal grill, the additional configurations corresponding to different sensitivity levels, the additional configurations comprising different temperatures for the at least one warm region or at least one cool region; wherein configuring the thermal grill to the stored configuration comprises configuring the thermal grill to a stored configuration corresponding to a sensitivity level chosen by the driver.

7. A computer program product for preventing drowsiness in a driver of a vehicle, the computer program product comprising a non-transitory computer-readable storage medium including computer program code for:

determining a configuration for a thermal grill located on a steering wheel of the vehicle corresponding to a level below a pain threshold of the driver, the thermal grill comprising warm regions interlaced with cool regions, the thermal grill located on an outer surface of the steering wheel such that at least one warm region and at least one cool region simultaneously configured to different temperatures are exposed on the outer surface of the steering wheel at a location on the steering wheel such that the at least one warm region and the at least one cool region are in contact with a hand of the driver when the driver is gripping the steering wheel, the determining including:

configuring the at least one warm region to a first temperature, configuring the at least one cool region to a second temperature, and receiving input indicating whether the thermal grill, including regions with the first temperature and the second temperature, produces an uncomfortable sensation for the driver;

storing the determined configuration for the thermal grill corresponding to the level below the pain threshold of the driver; and configuring the thermal grill to the stored configuration during vehicle operation.

8. The computer program product of claim 7, wherein the thermal grill is configured to the stored configuration responsive to receiving an input indicating that the driver wants the thermal grill configured.

9. The computer program product of claim 7, wherein the thermal grill is configured to the stored configuration after an amount of time has elapsed since receiving an input indicating that the driver does not want the thermal grill configured.

10. The computer program product of claim 8, further comprising computer program code for providing a warning to the driver before configuring the thermal grill to the stored configuration.

11. The computer program product of claim 9, wherein the step of determining the configuration is repeated after an amount of time has lapsed.

12. The computer program product of claim 10, further comprising computer program code for:

storing additional configurations for the thermal grill, the additional configurations corresponding to different sensitivity levels, the additional configurations comprising different temperatures for the at least one warm region or at least one cool region; wherein configuring the thermal grill to the stored configuration comprises configuring the thermal grill to a stored configuration corresponding to a sensitivity level chosen by the driver.

13. A computer system for preventing drowsiness in a driver of a vehicle, the computer system having a processor and a computer readable medium, the computer readable medium including computer program code for:

determining a configuration for a thermal grill located on a steering wheel of the vehicle corresponding to a level below a pain threshold of the driver, the thermal grill comprising warm regions interlaced with cool regions, the thermal grill located on an outer surface of the steering wheel such that at least one warm region and at least one cool region simultaneously configured to different temperatures are exposed on the outer surface of the steering wheel at a location on the steering wheel such that the at least one warm region and the at least one cool region are in contact with a hand of the driver when the driver is gripping the steering wheel, the determining including:

configuring the at least one warm region to a first temperature, configuring the at least one cool region to a second temperature, and receiving input indicating whether the thermal grill, including regions with the first temperature and the second temperature, produces an uncomfortable sensation for the driver;

storing the determined configuration for the thermal grill corresponding to the level below the pain threshold of the driver; and configuring the thermal grill to the stored configuration during vehicle operation.

14. The computer system of claim 13, wherein the thermal grill is configured to the stored configuration responsive to receiving an input indicating that the driver wants the thermal grill configured.

15. The computer system of claim 13, wherein the thermal grill is configured to the stored configuration after an amount of time has elapsed since receiving an input indicating that the driver does not want the thermal grill configured.

16. The computer system of claim 13, further comprising computer program code for providing a warning to the driver before configuring the thermal grill to the stored configuration.

17. The computer system of claim 13, wherein the step of determining the configuration is repeated after an amount of time has lapsed.

18. The computer system of claim 13, further comprising computer program code for:

storing additional configurations for the thermal grill, the additional configurations corresponding to different sensitivity levels, the additional configurations comprising different temperatures for the at least one warm region or at least one cool region; wherein configuring the thermal grill to the stored configuration comprises configuring the thermal grill to a stored configuration corresponding to a sensitivity level chosen by the driver.

* * * * *

UNITED STATES PATENT AND TRADEMARK OFFICE

CERTIFICATE OF CORRECTION

PATENT NO. : 8,963,724 B2
APPLICATION NO. : 13/237768
DATED : February 24, 2015
INVENTOR(S) : Hsuan Chang It is certified that error appears in the above-identified patent and that said Letters Patent is hereby corrected as shown below:

In the claims:

Claim 10, column 9, line 3, delete "claim 8," and insert --claim 7--.
Claim 11, column 9, line 7, delete "claim 9," and insert --claim 7--.
Claim 12, column 9, line 10, delete "claim 10," and insert --claim 7--.

Signed and Sealed this
Fifteenth Day of March, 2016

Michelle K. Lee

Michelle K. Lee
*Director of the United States Patent and Trademark Office*